United States Patent [19]

Korytko

[11] Patent Number: 4,907,436

[45] Date of Patent: Mar. 13, 1990

[54] STEP FORGING PRESS

[75] Inventor: Myron I. Korytko, Erie, Pa.

[73] Assignee: Efco, Inc., Erie, Pa.

[21] Appl. No.: 255,781

[22] Filed: Oct. 11, 1988

[51] Int. Cl.[4] ..... B21J 13/04

[52] U.S. Cl. ..... 72/184; 72/207

[58] Field of Search ..... 72/184, 192, 207, 244

[56] References Cited

U.S. PATENT DOCUMENTS

| | | | |
|---|---|---|---|
| 939,167 | 11/1909 | Sack | 72/244 |
| 3,415,095 | 12/1968 | Bringewald | 72/184 |
| 3,521,472 | 7/1970 | Bringewald | 72/184 |
| 3,847,004 | 11/1974 | Bringewald | 72/184 |
| 4,514,998 | 5/1985 | Jury | 72/207 |
| 4,608,848 | 9/1986 | Mele | 72/184 |

*Primary Examiner*—Lowell A. Larson

*Attorney, Agent, or Firm*—Baldwin, Egan & Fetzer

[57] ABSTRACT

A forging press comprising a base with a pressure roller mounted in spaced relation to the base and in conjunction with the latter defining a pressure zone, with a mechanism for conveying work between the base and the roller through the zone. The work conveying mechanism includes a plurality of discrete generally relatively movable die segments coacting with a confining frame, for maintaining the die segments in assembled but movable relation relative to one another, and providing for the aforesaid movement responsive to pressure applied to the die segments by the roller and the formation or step forging by the die segments of an associated work blank into a produced part, during passage of the mechanism and the work blank through the zone. Each die segment includes a roller pressure end and a molding end, and a pressure transmitting insert movably coacts with the roller pressure end of each die segment, and provides for mating relation of the insert with the roller, during movement of the work through the zone, whereby the part is generally smoothly forged from the work blank into finished to close to finished condition.

14 Claims, 3 Drawing Sheets

STEP FORGING PRESS

This invention relates in general to a step forging press, and more particularly to a step forging press that utilizes a plurality of discrete die segments relatively movable with respect to one another, each including a roller pressure end and a molding end, and in conjunction with a relatively large pressure roller, provide for pressurized formation by the die segments of an associated work blank into a produced part, and wherein each of the die segments includes means movably coacting with the roller pressure end thereof and adapted for generally mating relation with the pressure roller during movement of the work through a pressure zone, whereby the part is generally smoothly forged from the associated work blank into finished or close to finished condition.

BACKGROUND OF THE INVENTION

Step forging presses utilizing a plurality of discrete die segments and utilizing a pressure means for forcing the die segments into an associated work blank to produce a formed part are known in the art. Such prior art pressure means includes an endless belt-like arrangement of a plurality of rollers which provides for applying pressure to the discrete die segments in a pressure zone as the work passes through the pressure zone.

U.S. Pat. No. 3,847,004 dated Nov. 12, 1974 in the name of August R. Bringewald and entitled Apparatus and Method for Applying Pressure and Die and Method for Forming a Part, and U.S. Pat. No. 4,608,848 dated Sept. 2, 1986 to Joseph J. Mele and entitled Part Forming Apparatus by Flow Forging, are examples of such prior art arrangements.

Also, U.S. Pat. No. 3,415,095 dated Dec. 10, 1968 to A. R. Bringewald and entitled Process and Apparatus for Producing Metal Plates With Integral Stiffeners, and U.S. Pat. No. 3,521,472 dated July 21, 1970 in the name of A. R. Bringewald and entitled Process and Apparatus for the Production of Parts From Ductile Metals With Integral Stiffeners on One or Both Sides, disclose the use of a pair of relatively large pressure rollers for forming a part from a ductile blank, but wherein unitary die structure is utilized rather than using discrete die segments of the first identified prior art patents.

SUMMARY OF THE INVENTION

The present invention provides a novel forging press comprising a base and a relatively large pressure roller coacting with the base for defining a pressure zone between the base and the pressure roller, and including a die mechanism for taking a work blank and forming it by a plurality of discrete relatively movable die segments, into a produced part, during passage of the work blank and die mechanism through the pressure zone, with each die segment including a roller pressure end and a molding end, with means movably coacting with each die segment roller pressure end and adapted for generally mating relationship with the pressure roller, during movement of the work through the pressure zone, for generally smoothly applying forging pressure from the roller to each die segment and thence to the work blank, whereby the part is smoothly forged from the work blank into finished or close to finished condition.

Accordingly, an object of the invention is to provide a novel forging press.

A further object of the invention is to provide a forging press comprising a base with a relatively large pressure roller coacting with the base, and in conjunction with the latter defining a pressure zone, together with means for conveying work between the base and the roller through the zone, with the latter including a plurality of discrete die segments coacting with confining means, for confining the die segments and providing for generally smooth formation by the die segments of an associated work blank, into a produced part, during passage through the zone.

A still further object of the invention is to provide a forging press of the latter type wherein each of the die segments includes a roller pressure end and a molding end, together with means movably mounted on and coacting with the roller pressure end, and adapted for generally complementary mating relation with the pressure roller during movement of the work through the zone, whereby the roller pressure is generally smoothly applied to the die segments as the latter and associated work blank move through the zone, and the part produced is smoothly forged from the work blank into finished or near to finished condition.

Another object of the invention is to provide a forging press of the aforementioned type wherein the pressure roller thereof may have a diameter of approximately 75 times, or more, the thickness dimension of each die segment, whereby the reaction force applied to the roller by each individual die segment during forging of the produced part is relatively small.

A still further object of the invention is to provide a forging press of the aforementioned type wherein the means movably mounted adjacent each roller pressure end of each die segment comprises a semicylindrical-like shape insert coacting with a complementary semicylindrical-like bearing surface in the roller pressure end of each die segment, and with such insert having a concave upper surface of a radius of approximately the same as the radius of the external cylindrical surface of the pressure roller, so that the pressure roller coacts in generally surface-to-surface mating relation with the insert concave surface during movement of the work through the zone.

Other objects and advantages of the invention will be apparent from the following description taken in conjunction with the accompanying drawings wherein:

DESCRIPTION OF PREFERRED EMBODIMENT

Figure 1:
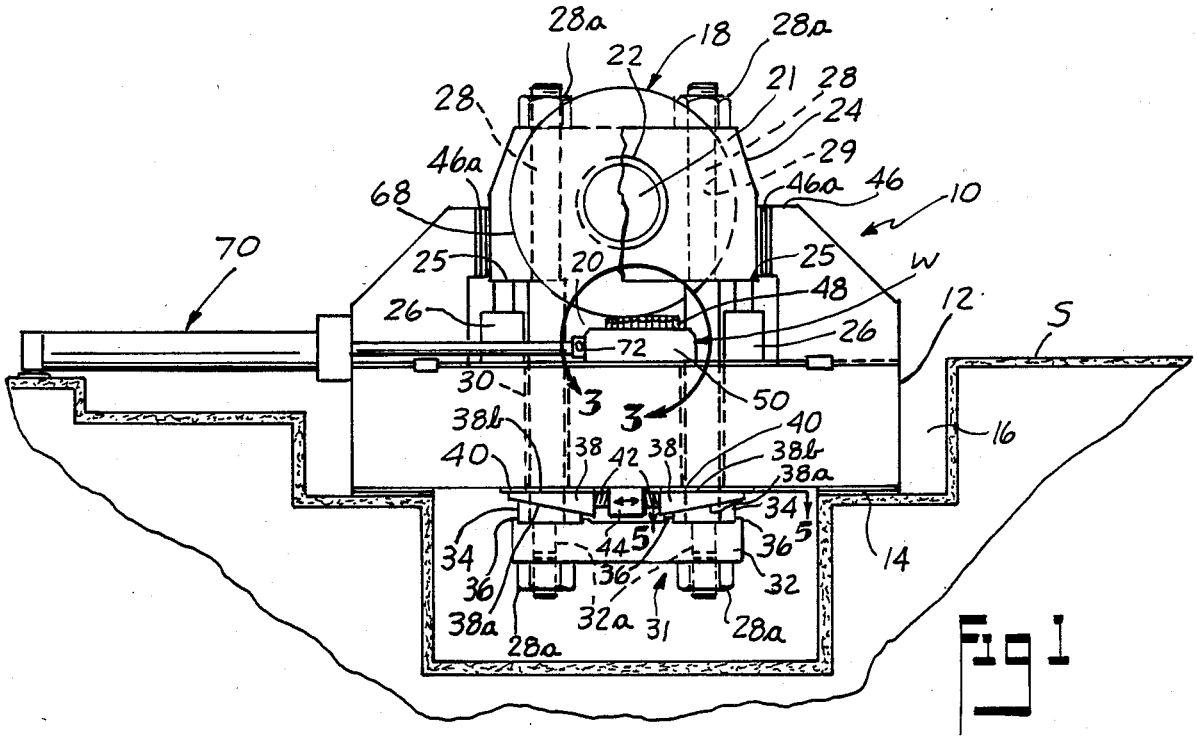
FIG. 1 is a partially broken, side elevational view of a forging press embodying the invention.

Referring now again to the drawings, there is disclosed a forging press 10 embodying the invention and comprising a base 12 which in the embodiment illustrated is shown as being mounted on vibration absorbing pads 14 disposed in a concrete lined recess 16 in surface S.

A relatively large size pressure roller 18 is mounted above base 12, and coacts therewith to define a pressure zone 20 between the base and the pressure roller, through which work W is adapted to be moved, so as to produce a manufactured part, and as will be hereinafter described in detail.

The roller 18 (which is an idler roller) includes, in the embodiment illustrated, a shaft 21 which extends laterally at both ends of the roller 18, and with such laterally extending shaft ends being mounted in thrust bearings 22, which in turn are supported in a roller housing 24 which in turn may be movably supported on surfaces 25 of base structure 12.

Fluid powered motor units 26 are preferably provided, and which are supported on the base 12 of the press and which are adapted to engage the underside of the roller housing 24 generally adjacent the four corners thereof. It will be seen therefore that upon actuation of the motor units 26 and outward projection or extension of the piston rods thereof, the roller 18 and housing 24 is adapted to be moved vertically away from the base 12 of the press, and upon retraction of the piston rods of the roller units 26, the pressure roller 18 and housing 24 is adapted to move in a direction toward the base 12 of the press.

Tie rods 28, which include threaded nuts **28*a* at the respective ends of each tie rod, extend through openings 29 in the roller housing 24, down through preferably tubular guide sleeves 30 in the base 12, to project below the base 12**.

Lower nuts **28*a* coacting in threaded relation with the lower threaded end of a respective tie rod, support wedge mechanism 31, which includes in the embodiment illustrated a wedge platen 32, with the tie rods 28 extending through openings 32*a* in the platen 32, and with platen 32 supporting thereon preferably machined, wedged blocks 34 which may be held in position on platen 32 by means of shoulder lugs 36** on the platen (FIG. 1).

Coacting with each of the wedge blocks 34 is a preferably machined wedge member 38, which in the embodiment illustrated includes a generally oblique or sloping wedge surface **38*a* coacting in engaged relation with the confronting sloping surface on the associated wedge block, and a generally flat generally horizontally oriented surface 38*b*. Surface 38*b* is adapted for engagement with an overlying wear plate 40 which is suitably attached as by welds or any other suitable means, to the underside of the base structure 12**.

Wedge members 38 are preferably connected by pairs of right and left hand threaded shafts 42 (FIG. 1) to a power unit 44 which may be hydraulically powered, so that upon actuation of the power unit 44, the wedge members 38 are moved outwardly away from the power unit 44 or inwardly toward the power unit 44, depending upon the direction of rotation of the threaded shafts 42. It will be seen that outward movement of the wedge members 38 relative to the motor unit 44 will (if there is slack in the wedge mechanism) cause downward movement of the platen 32 with respect to the base 12 and thus downward pulling force on tie rods 28. Thus, it will be seen that the wedge mechanism 31 insures that the pressure roller 18 and associated housing 24 upon adjustment thereof by means of the fluid powered motor units 26 to adjust the height of the pressure zone, are tightly held in position with respect to the base 12 by means of tie rods 28 and associated nuts **28*a***, so as to maintain the selected height dimension of the pressure zone.

The tie rods 28 and associated nuts **28*a* are preferably prestressed, so that as the work is drawn through the pressure zone between the rotatable roller 18 and the base 12, there is no material tendency for elongation of the tie rods, or change in the pressure zone height defined by the distance between the pressure roller 18 and the base 12**.

Figure 5:
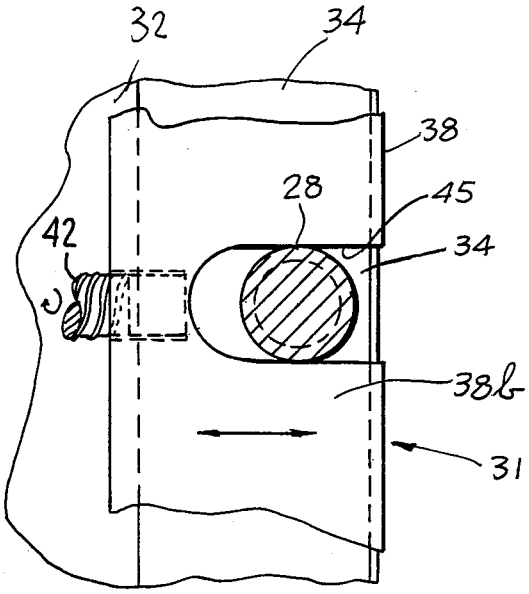
FIG. 5 is an enlarged fragmentary, plan view taken generally along the plane of line 5—5 of FIG. 1 looking in the direction of the arrows, and illustrating one of the wedge members of the wedge apparatus, for tightening the tie rod connection of the pressure roller housing and roller to the base of the foring press.

Referring now in particular to FIG. 5, each wedge member 38 may be slotted as at 45 so as to permit inward and outward movement of the wedge member (upon actuation of motor unit 44) relative to the associated tie rod members 28 which pass through the respective wedge member and underlying wedge block 34.

The base 12 also includes in the embodiment illustrated, a roller housing guide structure 46 projecting upwardly from the horizontal portion of the base 12 and partially encompassing the roller housing 24, and which may be provided with thrust pads **46*a* disposed in confronting relation with respect to the vertical surfaces of the roller housing 24, so as to maintain and guide the housing 24 and associated pressure roller 18 in positive positional relationship in a horizontal direction with respect to the base 12**.

Figure 3:
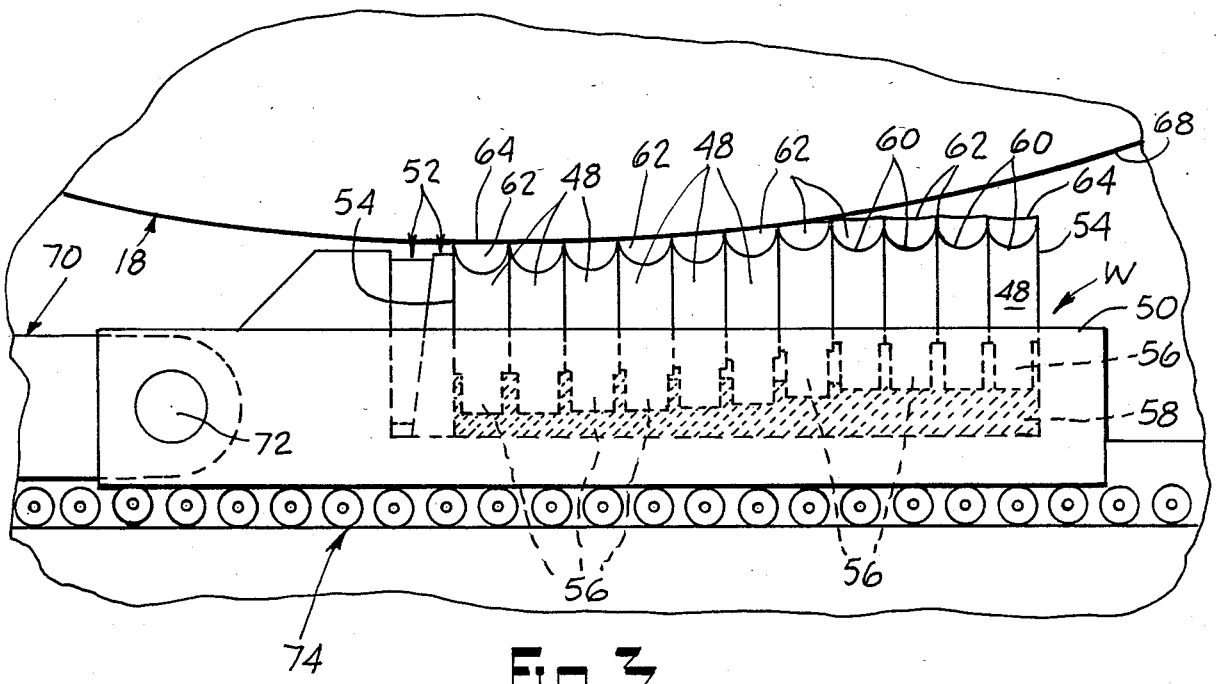
FIG. 3 is an enlarged, fragmentary view taken generally in the area of the arrow 3—3 in FIG. 1, and showing the coaction between the relatively large pressure roller and the movable pressure transmitting insert of each of the die segments, as the work passes through the pressure zone defined between the pressure roller and the underlying base; in this illustration, a roller conveyor is illustrated as being disposed on the base and supporting the work, for facilitating the movement of the work through the pressure zone.
Figure 2:
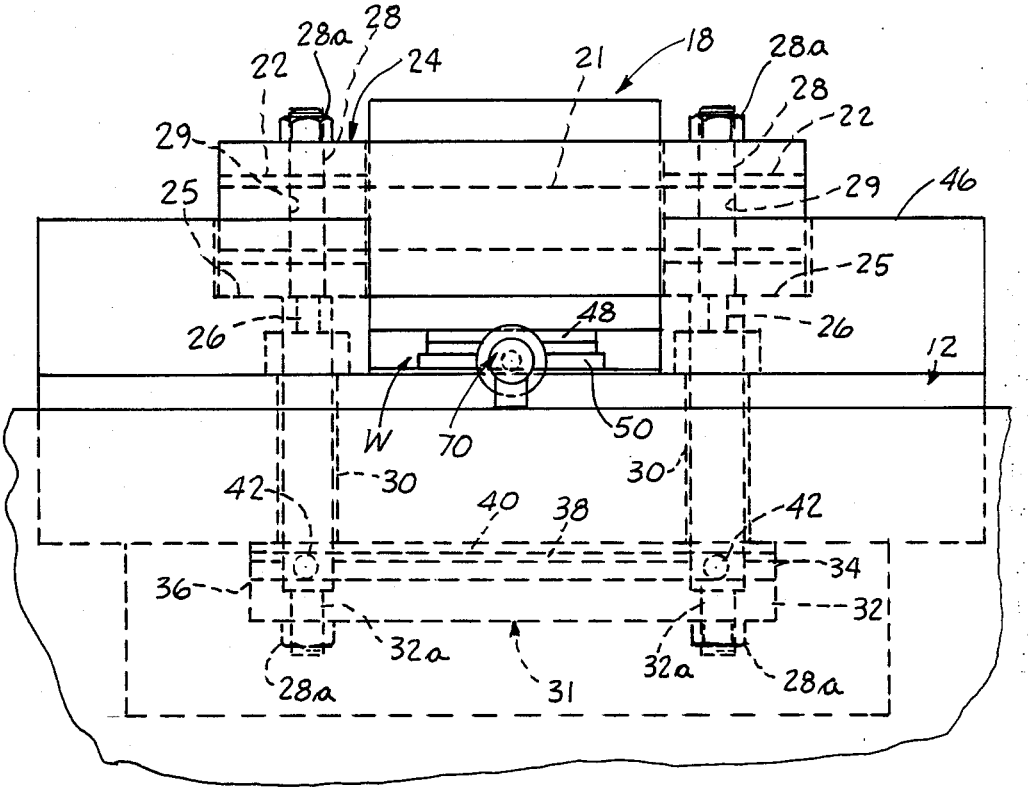
FIG. 2 is an end elevational view of the press of FIG. 1, taken from the left hand side of FIG. 1.
Figure 4:
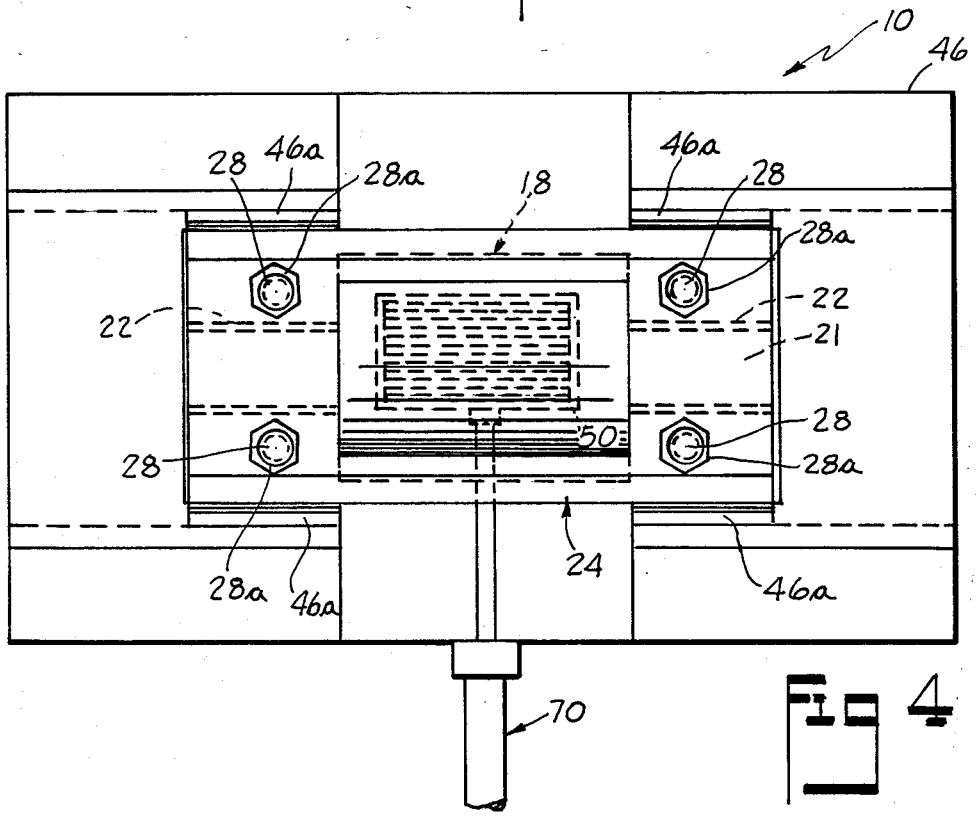
FIG. 4 is a top plan view of the forging press of FIGS. 1 and 2.

Referring now in particular to FIG. 3, the latter is an enlarged side elevational illustration of the work conveying apparatus and die mechanism. The die mechanism comprises a plurality of discrete die segments 48 disposed in side-by-side relationship with respect to one another and mounted in a confining work frame 50, so as to maintain the die segments in assembled but relatively vertically movable, with respect to one another, relationship. A wedging mechanism 52 of conventional known type can be utilized to maintain the upright orientation, relatively vertically movable condition of the die segments 48 with respect to one another.

Each of the die segments 48 comprises a pressure roller end 54 and a molding end 56, with the molding end being adapted to engage the work blank 58, and upon downward movement of the die segments, causing forging of the blank 58 into the desired part to be produced.

Figure 6:
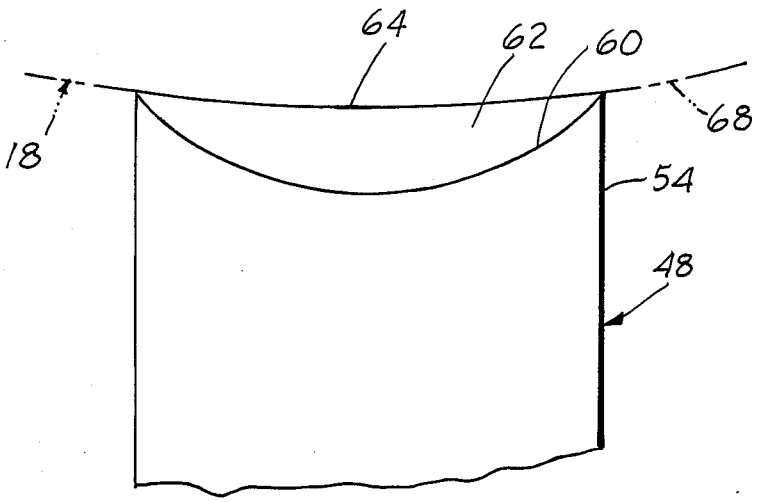
FIG. 6 is an enlarged, fragmentary, side elevational view of one of the die segments of the die mechanism, illustrating the semicylindrical-like pressure transmitting insert coacting with the upper end of the die segment in a complementary concave seat formed in the segment, with the insert having a concave upper surface adapted to mate in a complementary manner with the exterior periphery of the overlying pressure roller for transmission of pressure from the roller to the die segment.

The roller pressure end 54 includes in the embodiment illustrated, a concave seat 60 on which is movably mounted a generally semicylindrical-like segmental pressure transmitting insert 62, for generally rotary surface-to-surface movement of the insert 62 with respect to its respective complementary seat 60 in the respective die segment. The upper end of each insert 62 is provided with a generally concave surface 64 that is adapted to mate in a complementary generally surface-to-surface manner with the exterior surface 68 of the pressure roller 18, when the roller engages with the pressure transmitting inserts 62, thus insuring a smooth application of the pressure from the roller 18 to each respective die segment 48 as the work passes through the pressure zone, whereby the part is smoothly forged from the associated work blank into finished or close to finished condition. As may be readily seen from FIGS. 3 and 6, the diameter of the pressure roller 18 is larger than the dimension of the defining chord of insert surface 64.

A reciprocal, preferably double acting, preferably fluid powered (e.g. hydraulic) motor unit 70 may be provided for moving the work through the pressure zone. The piston rod of motor unit 70 may be pivoted at one end as at 72, to the confining work frame 50, and at the other end thereof may be secured to surface S, as best shown in FIG. 1.

A roller conveyor 74 of relatively closely spaced rotatable rollers (FIG. 3) may be provided on the base 12 for facilitating the movement of the work through the pressure zone, or in certain instances the work may be supported directly on a flat wear plate supported on the base, with such wear plate being preferably provided with some means for lubricating same, for facilitating movement of the work through the pressure zone, and with respect to the underlying lubricated wear plate.

From the foregoing discussion and accompanying drawings, it will be seen that the invention provides a novel step forging press comprising a relatively large pressure roller coacting with a base to define a pressure zone between the roller and the base through which the work is passed, with each of the discrete die segments of the die mechanism having means coacting with an end thereof and adapted for generally complementary mating relation with the pressure roller during movement of the work through the zone, whereby the part is smoothly forged from the associated work blank.

The invention also provides a forging press or the aforementioned type which includes means for adjusting the working dimension of the pressure zone, and wherein a novel wedging mechanism is provided for expeditiously maintaining such adjusted pressure zone dimension.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

I claim:

1. A forging press comprising a base, a pressure roller spaced from said base and in conjunction with the latter defining a pressure zone, means for conveying work between said base and said roller through said zone, said means including a plurality of discrete die segments coacting with confining means for confining said die segments and providing for formation by said die segments of an associated work blank into a produced part during passage through said zone, said die segments including a roller pressure end and a molding end, and means on each die segment movably coacting with said roller pressure end and having a concave surface thereon adapted for disposal in confronting relation with said roller and movably coacting with said roller pressure end, and adapted for generally complementary surface-to-surface mating relation with the confronting convex surface of said roller during movement of said work through said zone, whereby the part is smoothly forged from the associated work blank, said roller having a diameter which is larger as compared to the dimension of the defining chord of said concave surface of the last mentioned means.

2. A press in accordance with claim 1 wherein said roller is mounted in a housing and adjustable means coacting between said housing and said base for adjusting the dimension of said pressure zone between said roller and said base.

3. A press in accordance with claim 1 including tie rod means coacting between said housing and said base for resisting movement of said housing and roller away from said base during movement of the work through said zone.

4. A press in accordance with claim 3 including means for adjusting the permissible positions of said housing and roller relative to said base and upon said adjustment providing for slack-free coaction of said tie rod means to said base and to said housing in the adjusted position of the roller and housing with respect to said base.

5. A press in accordance with claim 4 wherein the fourth mentioned means comprises a movable wedge mechanism for selectively coacting between said base and said tie rod means for maintaining a tight relationship between the tie rod means and said base in any adjusted position of said housing and roller relative to said base.

6. A press in accordance with claim 1 wherein said work conveying means is adapted for movement in a longitudinal direction through said zone with said roller being spaced above said base and wherein the diameter of said roller is substantially greater than the longitudinally thickness of each die segment and approximately 75, or more, times greater, and wherein said means on each die segment occupies substantially the full longitudinal thickness of said roller pressure end of the respective die segment.

7. A press in accordance with claim 6 wherein the radius of curvature of said roller is about the same value as the radius of curvature of said concave surface of said last mentioned means.

8. A press in accordance with claim 7 wherein said roller pressure end of each of said die segments includes a generally concave, in side elevation, seat receiving said last mentioned means in complementary movable surface-to-surface relation, the radius of curvature of said seat being less than the radius of curvature of the first mentioned concave surface.

9. A press in accordance with claim 1 including a conveyor formed of rotatable rollers coacting with said base and extending in a longitudinal direction through said zone and on which the work is adapted to be supported in its movement through said zone, the diameter of each of the last mentioned rollers being less than the longitudinal thickness of the respective die segments.

10. A press in accordance with claim 1 wherein said last mentioned means comprises a generally arcuate insert movably mounted on a complementary arcuate surface on said roller pressure end of the respective die segment.

11. A forging press comprising a base, a pressure roller spaced from said base and in conjunction with the latter defining a pressure zone, means for conveying work between said base and said roller through said zone, said means including a plurality of discrete die segments coacting with confining means for confining said die segments and provided for formation by said die segments of an associated work blank into a produced part during passage through said zone, each of said die segments including a roller pressure end and a molding end, and means on each die segment movably coacting with said roller pressure end and having a concave surface thereon adapted for disposal in confronting relation with said roller and movably coacting with said roller pressure end, and adapted for generally complementary surface-to-surface mating relation with the confronting convex surface of said roller during movement of said work through said zone, whereby the part is smoothly forged from the associated work blank, said roller having a diameter which is larger as compared to the dimension of the defining chord of said concave surface of the last mentioned means, and wherein said roller is mounted in a housing, and including tie rod means coacting between said housing and said base for resisting movement of said housing and roller away from said base during movement of the work through said zone, means for adjusting the permissible position of said housing and roller relative to said base and upon said adjustment providing for slack-free coaction of said tie rod means to said base and to said housing in the adjusted position of the roller and housing with respect to the base, and wherein said adjusting means comprises a movable wedge mechanism for selectively coacting between said base and said tie rod means for maintaining a tight relationship between the tie rod means and said base in any adjusted position of said housing and roller relative to said base, and wherein said wedge mechanism comprises a movable wedge member operative to move reciprocally, a wedge adjusting platen secured to said tie rod means, and a wedge block mounted on said platen and coacting with said wedge member for forcing said platen outwardly relative to said base upon predetermined movement of said wedge member with respect to said wedge block, thus tightening said tie rod means relative to said housing and roller and said base.

12. A press in accordance with claim 11 wherein said wedge member comprises a slotted wedge which defines spaced wedge sections adapted to generally encompass the respective tie rod means, the latter passing through said slotted wedge, and providing for movement of the respective wedge member relative to the respective tie rod means in a direction generally transverse of the lengthwise axis of the respective tie rod means.

13. A press in a accordance with claim 11 including motor means coacting with said wedge member for actuating said wedge mechanism and causing said reciprocal movement of the wedge member, relative to said wedge block.

14. A press in accordance with claim 13 wherein said wedge mechanism includes rotatable shafts actuated by said motor means and including left and right hand threads thereon coacting with a spaced pair of said wedge members, for causing simultaneous outward or inward relative movement of said pair of said wedge members upon actuation of said motor means.

* * * * *